US006513804B2

(12) United States Patent
Baumann et al.

(10) Patent No.: US 6,513,804 B2
(45) Date of Patent: Feb. 4, 2003

(54) CONNECTING MODULE PROVIDING THE CONNECTION BETWEEN A PRINTER AND AN ENVELOPING MACHINE

(75) Inventors: Hervé Baumann, Paris (FR); Patrick Fournier, Paris (FR); Gilles Nauche, Ville d'Avray (FR)

(73) Assignee: Seacap, Boulogne-Millancourt (FR)

( * ) Notice: Subject to any disclaimer, the term of this patent is extended or adjusted under 35 U.S.C. 154(b) by 50 days.

(21) Appl. No.: 09/876,737

(22) Filed: Jun. 7, 2001

(65) Prior Publication Data

US 2001/0042467 A1 Nov. 22, 2001

Related U.S. Application Data

(63) Continuation of application No. PCT/FR00/02631, filed on Sep. 22, 2000.

(30) Foreign Application Priority Data

Oct. 15, 1999 (FR) ..... 9912890

(51) Int. Cl.[7] ..... B65H 5/00
(52) U.S. Cl. ..... 271/264; 198/570
(58) Field of Search ..... 271/264, 9.01, 271/279, 69, 306, 198; 198/570

(56) References Cited

U.S. PATENT DOCUMENTS 4,835,574 A * 5/1989 Ohi ..... 271/279 X
5,819,666 A 10/1998 Ishikawa et al. ..... 101/483
6,016,638 A * 1/2000 Bernard et al.
6,179,288 B1 * 1/2001 Bezelga et al. ..... 271/225
6,338,479 B1 * 1/2002 Van Der Werff et al. . 271/69 X

FOREIGN PATENT DOCUMENTS

| | | |
|---|---|---|
| EP | 0 903 248 A1 | 3/1999 |
| GB | 2769871 | 10/1997 |
| WO | WO96/15967 | 11/1995 |
| WO | WO98/52755 | 5/1998 |

* cited by examiner

*Primary Examiner*—David H. Bollinger
(74) *Attorney, Agent, or Firm*—St.Onge Steward Johnston & Reens LLC

(57) ABSTRACT

This connecting module, inserted between a printer and an enveloping machine, comprises a first zone for receiving documents, a second zone for receiving documents, a sheet outlet zone and an envelope outlet zone, first conveying means connecting the first receiving zone to the sheet outlet zone, second conveying means connecting the first receiving zone to the envelope outlet zone, and third conveying means connecting the second receiving zone to the envelope outlet zone, controllable routing means being located on a common inlet section of the first and second conveying means so as to select the path according to the type of document arriving in the receiving zone.

8 Claims, 3 Drawing Sheets

CONNECTING MODULE PROVIDING THE CONNECTION BETWEEN A PRINTER AND AN ENVELOPING MACHINE

CROSS REFERENCE OF RELATED APPLICATIONS

This application is a continuation of pending International Application PCT/FR00/02631 filed on Sep. 22, 2000, which designates the United States. This application claims priority from French Patent Application FR 9912890 filed on Oct. 15, 1999.

The present invention relates to mail processing machines. It relates more specifically to a connecting module intended to be inserted between a printer and an enveloping machine.

Mail processing departments use automatic machines for placing pre-printed documents in envelopes. In order to avoid manual operations, those skilled in the art have conceived of the idea of creating autonomous machines capable of printing the documents and the envelopes and then putting the documents in the envelopes. There are a number of approaches currently in existence:

A first approach, set out in document U.S. Pat. No. 5,819,666, relies on the creation of a fully integrated printed and enveloping machine having all the required functions.

A second approach, set out in document FR 2 769 871, relies on making far-reaching modifications to the conventional enveloping machine so as to allow it to perform the various tasks and to solve the technical problems associated with connecting the printer to the enveloping machine. These modifications stem from the fact that the printers on the market, used in offices, are only capable of processing windowless envelopes and that the orientation of said envelope leaving the printer may be longitudinal or transversal depending on the make of printer.

Both approaches have the drawback of demanding expensive conversion of the office equipment.

An object of the invention is to propose a novel solution that makes it possible to perform the various enveloping tasks mentioned hereinabove, namely the processing of envelopes with or without windows (or more generally, envelopes which are or are not able to take printing to pass undamaged through the printer), and offers the possibility of enveloping printed envelopes which are oriented, on leaving the printer, in the longitudinal direction or in the transverse direction, while at the same time remaining within the context of conventional existing office equipment, that is to say comprising a printer and a conventional enveloping machine.

The present invention achieves its objective by virtue of an autonomous connecting module that makes it possible to avoid modifying the printer or the enveloping machine in order to make this connection, it being possible for said connecting module to fit the various types of printer on the market while at the same time allowing the printer and the enveloping machine to operate solo. More specifically, the invention relates to a connecting module intended to be inserted between a printer comprising an outlet for printed documents in the form of sheets of paper and envelopes, and an enveloping machine comprising at least one sheet inlet and an envelope inlet, characterized in that it comprises a first zone for receiving documents, which can be aligned with the printed documents outlet of the printer, a second zone for receiving documents, which can be fed with envelopes, a sheet outlet zone which can be aligned with the sheet inlet of the enveloping machine, and an envelope outlet zone which can be aligned with the envelope inlet of the enveloping machine, first conveying means connecting the first receiving zone to the sheet outlet zone, second conveying means connecting the first receiving zone to the envelope outlet zone, and third conveying means connecting the second receiving zone to the envelope outlet zone, controllable routing means being located on a common inlet section of the first and second conveying means in order to select the conveying means according to the type of printed document arriving in the first receiving zone.

Advantageously, the second conveying means comprise an envelope righting device in order to reorientate the envelopes which are not in the desired orientation. As a preference, this is a gravity righting device comprising a narrow well through which the envelope falls, equipped with a retractable intermediate obstacle followed downstream by an envelope joggling device. The joggling device may comprise a system of rollers on which the envelope is received and which transport it to a reference stop.

Advantageously, the second and third conveying means comprise a section controlled by a common motor.

Advantageously, the module forms part of an installation comprising support means for the printer and the enveloping machine, in which installation the said support means are mounted so that they can slide, so that the printer and the enveloping machine can be detached and moved away from the module, so as to allow them to operate independently, or so as to facilitate maintenance or repair work on one or other of the components.

Advantageously, the module comprises a built-in envelope magazine, preferably with a moving tray.

The module according to the invention therefore makes it possible to:

- receive the sheet or the windowless envelope from the printer,
- remove from the stack a window envelope incapable of passing through the printer,
- direct the sheet printed by the printer to the sheet feed of the enveloping machine,
- direct the envelope printed by the printer to a referencing mechanism, having turned it through 90 degrees if need be,
- direct the printed envelope from the referencing mechanism to the envelope feed of the enveloping machine,
- direct the window envelope to the envelope feed of the enveloping machine.

Sheets or windowless envelopes from the printer are received opposite the outlet thereof. Said documents are taken up by conveyor belts and other belt guide pulleys.

When the documents are sheets printed by the printer, they are directed to the sheet feed of the enveloping machine by routing and conveyor belts, said routing device being in the lowered position.

When the documents are envelopes printed by the printer, they are directed to the envelope feed of the enveloping machine.

For this purpose, the routing device, in the raised position, directs the envelope towards the bottom of the module. The envelope therefore drops down two guide plates, forming the drop well. If the orientation of said envelope leaving the printer is not compatible with the orientation needed for the enveloping machine, the envelope is turned in this freefall zone using a peg about which the envelope pivots as it falls. If the orientation leaving the printer is correct, it is obvious that the peg must not be in the path of the envelope. Said peg is therefore advantageously mounted so that it can be retracted, for example, it may consist of the plunger of an electromagnetic.

The referencing or joggling mechanism allows the envelope to be centered perfectly with respect to the enveloping machine so as to guarantee the quality of the insertion that will take place later. It consists of a set of rollers mounted transversely in the module and onto which the envelope falls.

These rollers rotate continuously and convey the envelope laterally to bring the latter into contact with the referencing plate. Said plate can be adjusted according to the width of the envelope.

The envelopes are then taken up by the device for conveying envelopes to the envelope feed of the enveloping machine.

Window envelopes, which cannot be processed by the printer, are placed in a stack in a motorized envelope magazine. They are removed from the stack there then transported by the device conveying envelopes to the envelope feed of the enveloping machine.

This device consists of two toothed belts equipped with joggles and of a collection of conveyor belts—rollers.

Further features and advantages will become apparent from the following description, given by way of nonlimiting indication. Reference will be made to the appended drawings in which.

Figure 1:
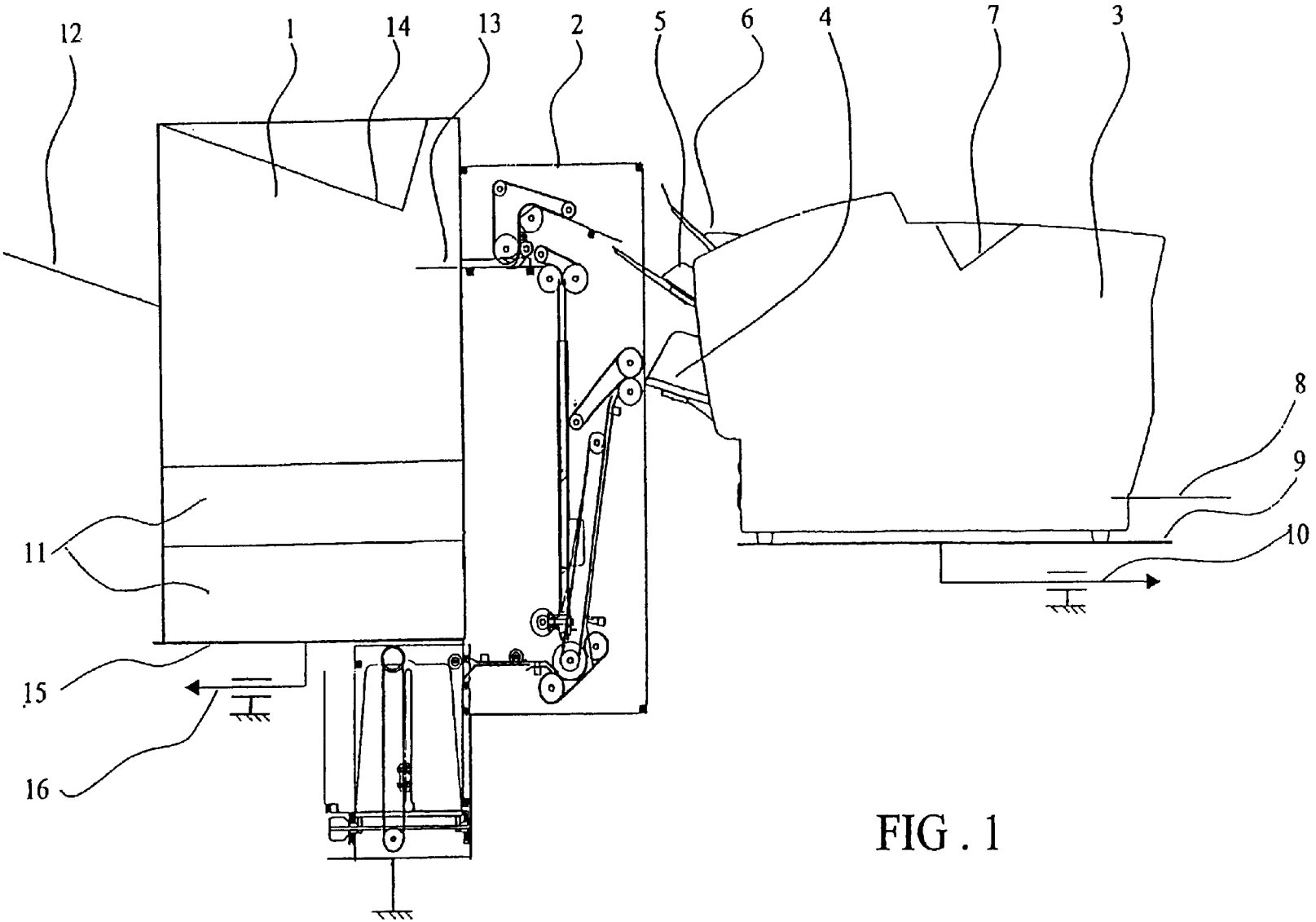
FIG. 1 is a front view of the mail processing assembly consisting of the printer, the connecting module and the enveloping machine. For ease of understanding, only the connecting module is depicted in section.

The mail processing assembly shown in FIG. 1 consists of a printer 1, the connecting module 2 and the enveloping machine 3.

The enveloping machine 3 is, for example, a machine of the type marketed under the reference SI2600 by the company SECAP. This enveloping machine allows various types of document to be folded and placed in envelopes, in order to lighten the workload of administration departments. It has a magazine of empty envelopes 4, two sheet feeds 5 and 6, an insert feed 7 and a filled envelope outlet 8. As this machine is not the subject of the present invention and as it is known to those skilled in the art, it will not be described in any greater detail.

It is to be noted that the enveloping machine 3 can operate solo without using the printer 1 and the connecting module 2. To do this, it rests on a sliding plate 9 which allows it to be detached from the other two machines 1 and 2 by shifting it in the direction of the arrow 10. This possibility of movement is very useful also for accessing the mechanisms of the connecting module 2 in the event of a paper jam.

The printer 1 is an office-type printer of the laser, inkjet or some other type and is able, amongst other things, to print A4 documents and windowless envelopes. Said envelopes come in several formats. Their width varies from 229 to 241 mm and their length form 105 to 115 mm. In the example described, the printer 1 is of the laser type and has two sheet feeds 11, one envelope feed 12 and one outlet 13 for any printed document, envelope or sheet. It is to be noted that this printer can operate solo without using the connecting module 2 and the enveloping machine 3. To do this, it rests on a sliding plate 15 allowing it to be disconnected from the other two machines 2 and 3 by shifting it in the direction of the arrow 16.

As before, this possibility of movement is very useful for accessing the mechanisms of the connecting module 2 in the event of a jam. In this mode of operation, the sheets are received in the receptacle 14.

Figure 2:
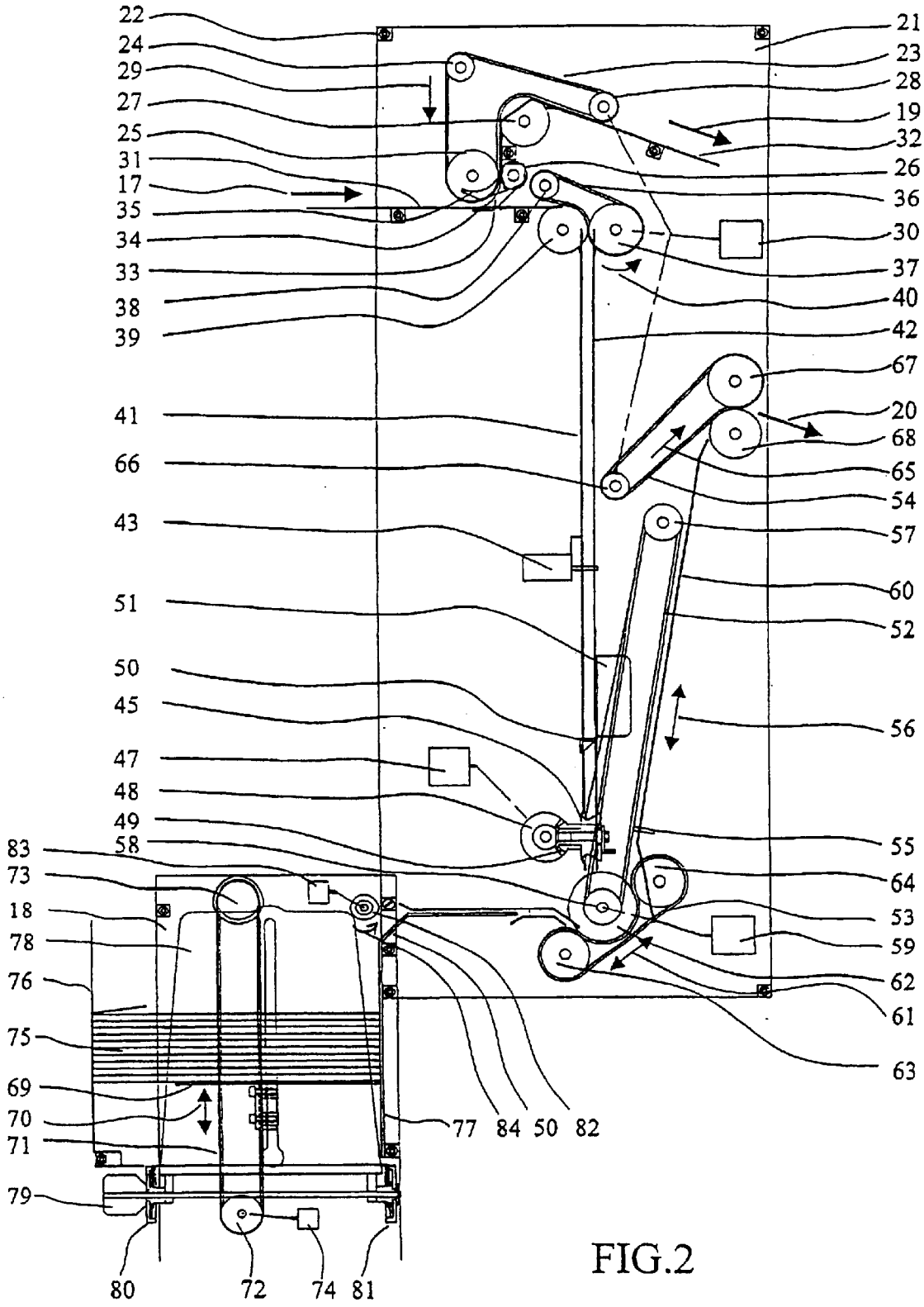
FIG. 2 is a detailed sectional front view of the connecting module of FIG. 1.
Figure 3:
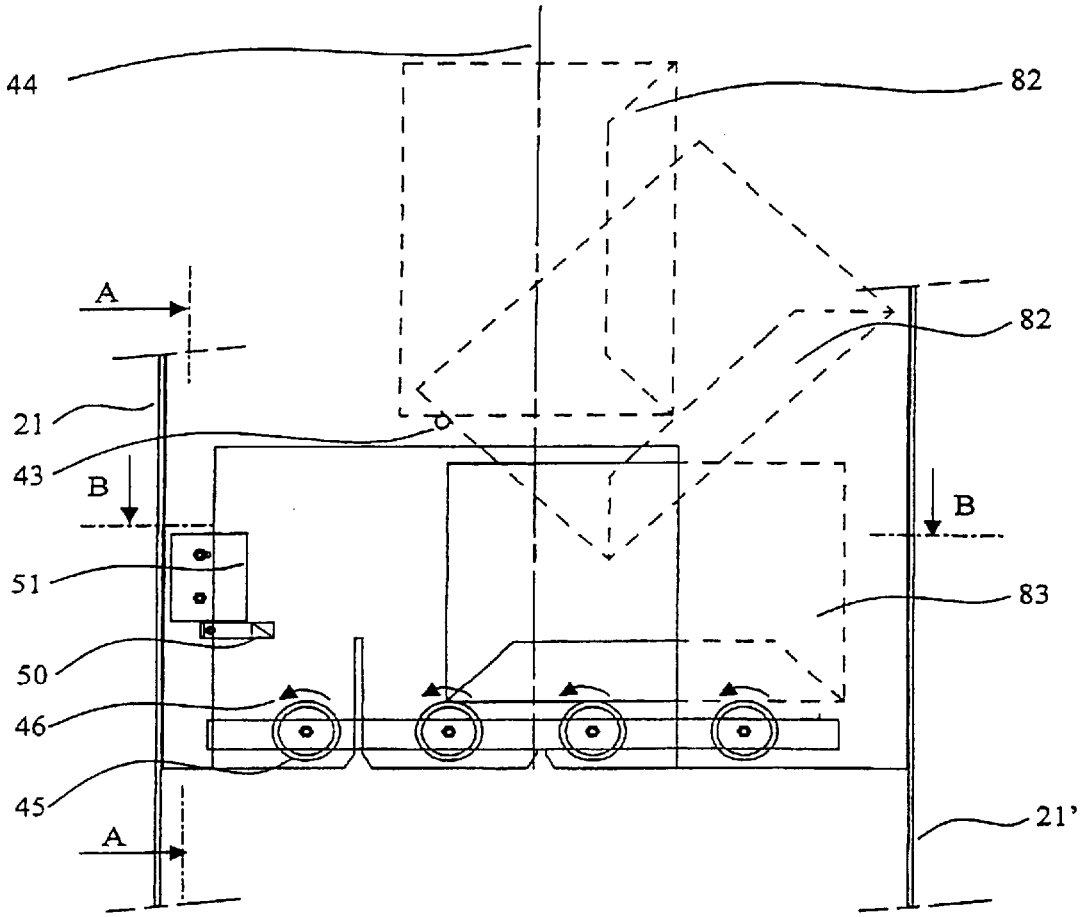
FIG. 3 is a view from the right of the zone which rotates and joggles the envelope in the connecting module.
Figure 4:
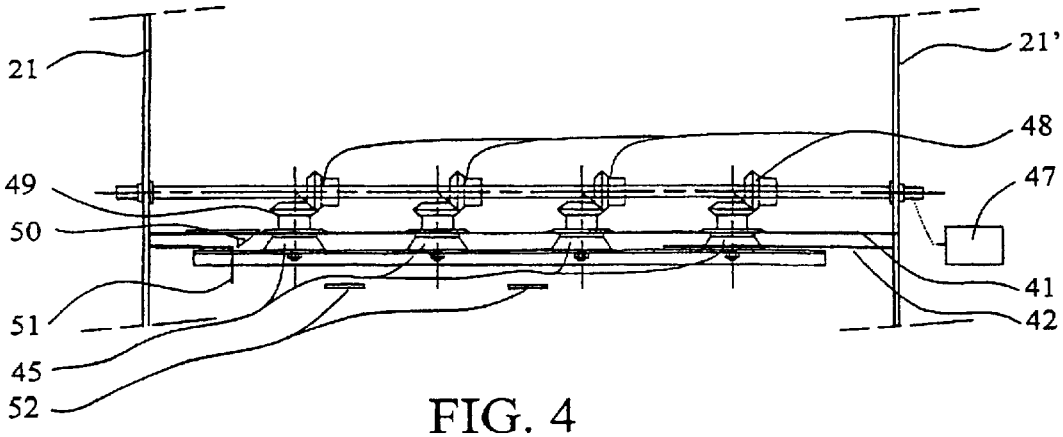
FIG. 4 is a section on B—B of FIG. 3, showing the joggling of the envelope in the connecting module.

The connecting module 2 shown in detail in FIG. 2 has four zones for conveying or outputting documents:

The first receiving zone, shown by the arrow 17, corresponds to the inlet for sheets or envelopes from the outlet 13 of the printer 1.

The second receiving zone 18 is a window envelope magazine specific to the connecting module 2.

The third zone, shown by the arrow 19, corresponds to the outlet for documents of the sheet type to the feed 5 of the enveloping machine 3.

The fourth zone, shown by the arrow 20, corresponds to the outlet of documents of the envelope type to the envelope fed 4 of the enveloping machine 3.

The module 2 comprises a structure formed of two main mounting plates 21 and 21' connected together by square spacers 22. All the mechanisms described hereinafter are fixed within this structure.

The module 2 comprises a first conveyor belt 23 wrapped around pulleys 24–25–26–27–28 and set in motion in the direction of the arrow 29 by the motor 30. For reasons of clarity, the connection between any motor and the member it drives has been depicted schematically.

The guide plates 31 and 32 collaborate with the conveyor belt 23 and the routing device 33 to form the sheet path allowing these sheets to pass from the first zone 17 to the third 19. The routing device 33 driven by an actuator, not depicted, can adopt two positions, a lowered position 34 which forces a document entering at 17 to take these first conveyor means, and a raised position 35 which, on the other hand, directs the document toward the second conveyor means.

A second conveyor belt 36 is wrapped around the pulleys 37, 38, 39 and is set in motion in the direction of the arrow 40 by the motor 30.

Two vertical plates 41 and 42 are mounted between the main mounting plates 21 and 21'. The plunger of the electromagnet 43, fixed to the plate 42, can pass through the plates 41 and 42. The electromagnet is offset with respect to the median axis 44 of the module 2. The plunger of the electromagnet 43 if need be forms an obstacle allowing the envelope to be turned.

The envelope referencing device is made up of four rollers 45 rotating continuously in the direction of the arrow 46. Said rollers 45 are set in motion by the motor 47 via the set of bevel gears 48, 49. The device also comprises a deflector plate 50 mounted on the vertical plate 41 and a joggling plate 51 mounted on the vertical plate 42.

The device conveying envelopes to the envelope feed of the enveloping machine comprises three separate paths formed by endless belts 52–53 and 54.

The path 52 comprises two toothed belts with joggles 55. They are set in motion in the direction of the arrow 56 via the pulleys 57–58 and motor 59. The plate 60, mounted between the mounting plates 21 and 21' is for supporting the envelope as it moves up.

The path 53 comprises three flat belts set in motion in the direction of the double arrow 61 via the pulleys 62–63–64 and the motor 59.

The path 54 comprises three flat belts set in motion in the direction of the arrow 65 via the pulleys 66–67–68 and the motor 30.

The device 18 for removing a window envelope from the stack comprises a moving tray 69 which can move up or down in the direction of the arrow 70. This movement is provided by the motor 74 via the set of pulleys and toothed belts 71–72–73. The stack of envelopes 75 is held in place during its movements by the plates 76, 77 and by the adjustable width gauges 78, 78'. Said width gauges can be adjusted by the operator according to the width of the envelopes using an operating knob 79 and rack devices 80, 81 well known to those skilled in the art. The envelope is removed from the stack by the rollers 82 which are set in motion by the motor 83 in the direction of the arrow 84.

The way in which the mail processing machine works in this embodiment has two distinct modes of operation depending on the type of envelope used.

When using windowless envelopes, the printer 1 prints the documents to be inserted and prints the address on the envelope.

The documents supplied by the printer enter the connecting module 2 in the direction of the arrow 17. It is to be noted that the three controllers of the machines 1, 2 and 3 are connected, which amongst other things allows the controller of the connecting module 2 to know the types of document supplied by the printer 1. In particular, the controller of the connecting module 2 is informed as to the orientation of the moving envelopes (transverse or longitudinal).

The envelope, printed first, is delivered by the printer 1. The control system for the connecting module 2 positions the routing device 33 in the raised position 35 and starts the motors 30 and 47. The envelope is then taken up by the conveyor belts 36 and changes from being conveyed horizontally to being conveyed vertically. The envelope then penetrates between the vertical plates 41 and 42. When the direction in which the envelope is conveyed in the printer is transversal whereas the direction in which the envelope is conveyed in the enveloping machine is longitudinal (or vice versa), the module 2 has to change the orientation of the envelope. To do that, the system interposes the plunger of the electromagnet 43 in the path of the envelope dropping between the vertical plates 41 and 42. Obviously, said electromagnetic may be located to the right or to the left of the axis 44, depending on the desired direction of rotation. The envelope then passes from the position 81 to the position 83 via the position 82, and does so simply using gravity. With the rollers 45 rotating in the direction of the arrow 46, the envelope is directed toward the joggling plate 51. In its translational movement it encounters the deflecting plate 50 which causes it to tip toward the belts 52. At the end of this movement, the envelope is resting on the belts 52 and on the joggle plate 51. The control system for the connecting module 2 then, via the motor 59, starts to rotate the pulley 58 in the clockwise direction. The joggles 55 therefore convey the envelope to the path 54, the latter takes it up and directs it toward the envelope feed 4 of the enveloping machine 3 in the direction of the arrow 20.

The document or documents to be placed in the envelope are then delivered by the printer 1 in the direction of the arrow 17. The control system for the connecting module 2 positions the routing device 33 in the lowered position 34. The document is deflected by the routing device 33 upward and taken up by the conveyor belts 23. The document is then directed to the document feed 5 of the enveloping machine 3 in the direction of the arrow 19.

When using window envelopes, the printer 1 simply prints the documents that are to be inserted.

The window envelopes are loaded by the operator onto the tray 69 of the module 18. The operator adjusts the lateral width gauges 78–78' by operating the knob 79 and brings the adjustable plate 76 to rest against the rear end of the stack of envelopes. The rollers 82 are then set in motion by the motor 83 in the direction of the arrow 84. The tray 69 rises on account of the motor 74 and of the set of belts and pulleys 71–72–73. The topmost envelope in the stack comes into contact with the rotating roller 82 and is directed towards the conveyor belt system 53. It is to be noted that the control system for the connecting module 2 has, via the motor 59, to start the pulley 62 rotating in the counterclockwise direction at a chosen instant. This is because there must be no collision between the joggles 55 and the envelope because the pulleys 58 and 62 belong to the same rotary shaft. The envelope is therefore taken up by the conveyor belt assembly 53 which changes it from being transported in a horizontal direction to being transported in an almost vertical direction by slipping it between the belts 52 and the plate 60. As before, the path 54 takes up the envelope and directs it to the envelope feed 4 of the enveloping machine 3 in the direction of the arrow 20.

The way in which the documents are processed is identical to the way set out in the usage of envelopes from the printer 1.

What is claimed is:

1. A connecting module intended to be inserted between a printer comprising an outlet for printed documents in the form of sheets of paper and envelopes, and an enveloping machine comprising at least one sheet inlet and an envelope inlet, characterized in that it comprises a first zone for receiving documents, which can be aligned with the printed documents outlet of the printer, a second zone for receiving documents, which can be fed with envelopes, a sheet outlet zone which can be aligned with the sheet inlet of the enveloping machine, and an envelope outlet zone which can be aligned with the envelope inlet of the enveloping machine, first conveying means connecting the first receiving zone to the sheet outlet zone, second conveying means connecting the first receiving zone to the envelope outlet zone, and third conveying means connecting the second receiving zone to the envelope outlet zone, controllable routing means being located on a common inlet section of the first and second conveying means in order to select the conveying means according to the type of printed document arriving in the first receiving zone.

2. The module as claimed in claim 1, characterized in that the second conveying means comprise an envelope righting device.

3. The module as claimed in claim 2, characterized in that the enveloping righting device comprises a narrow well through which the envelope falls, equipped with a retractable intermediate obstacle followed downstream by an envelope joggling device.

4. The module as claimed in claim 3, characterized in that the joggling device comprises a system of rollers and a reference stop.

5. The module as claimed in claim 1, characterized in that the second and third conveying means comprise a section controlled by a common motor.

6. The module as claimed in claim 1, characterized in that it forms part of an installation comprising support means for the printer and the enveloping machine, and in that the said support means are mounted so that they can slide.

7. The module as claimed in claim 1, characterized in that it comprises an envelope magazine.

8. The module as claimed in claim 7, characterized in that the magazine comprises a moving tray.

* * * * *